US007659473B2

(12) United States Patent
Ramstein

(10) Patent No.: US 7,659,473 B2
(45) Date of Patent: Feb. 9, 2010

(54) SYSTEM AND METHOD FOR PROVIDING HAPTIC FEEDBACK TO A MUSICAL INSTRUMENT

(75) Inventor: Christophe Ramstein, San Francisco, CA (US)

(73) Assignee: Immersion Corporation, San Jose, CA (US)

( * ) Notice: Subject to any disclaimer, the term of this patent is extended or adjusted under 35 U.S.C. 154(b) by 0 days.

(21) Appl. No.: 12/235,046

(22) Filed: Sep. 22, 2008

(65) Prior Publication Data

US 2009/0013857 A1 Jan. 15, 2009

Related U.S. Application Data

(63) Continuation of application No. 11/506,682, filed on Aug. 18, 2006, now Pat. No. 7,453,039, which is a continuation of application No. 10/891,227, filed on Jul. 15, 2004, now Pat. No. 7,112,737.

(60) Provisional application No. 60/533,671, filed on Dec. 31, 2003.

(51) Int. Cl.
*G10H 7/00* (2006.01)

(52) U.S. Cl. ..... 84/645; 345/156

(58) Field of Classification Search ..... 84/645; 345/156
See application file for complete search history.

(56) References Cited

U.S. PATENT DOCUMENTS

| | | | | |
|---|---|---|---|---|
| 5,189,242 | A * | 2/1993 | Usa | 84/743 |
| 2003/0068053 | A1* | 4/2003 | Chu | 381/118 |
| 2004/0130526 | A1* | 7/2004 | Rosenberg | 345/156 |
| 2004/0161118 | A1* | 8/2004 | Chu | 381/61 |

* cited by examiner

*Primary Examiner*—Jeffrey Donels
(74) *Attorney, Agent, or Firm*—Kilpatrick Stockton LLP

(57) ABSTRACT

A system and method for generating a haptic feedback signal correlated to a music signal and providing the haptic feedback signal to a musical instrument. The music signal can created by the musical instrument or from a file, e.g., a MIDI file. A processor can generate the haptic feedback signal using a look-up table in which the music signal is mapped to a corresponding haptic feedback signal or can compute the corresponding haptic feedback signal based on the parameters of the music signal. The processor provides the haptic feedback signal to an actuator for causing a haptic effect at the musical instrument in response to receiving the haptic feedback signal. The haptic feedback signal can be applied to an input member, such as a key on a keyboard or a string on a guitar, or to the housing of the musical instrument, such as the neck of a guitar.

17 Claims, 4 Drawing Sheets

SYSTEM AND METHOD FOR PROVIDING HAPTIC FEEDBACK TO A MUSICAL INSTRUMENT

CROSS-REFERENCE TO RELATED APPLICATIONS

This application is a continuation of U.S. patent application Ser. No. 11/506,682, now U.S. Pat. No. 7,453,039, filed Aug. 18, 2006, entitled "System and Method for Providing Haptic Feedback to a Musical Instrument," which is a continuation of U.S. patent application Ser. No. 10/891,227, now U.S. Pat. No. 7,112,737, filed Jul. 15, 2004, which claims priority to U.S. Provisional Application No. 60/533,671 filed Dec. 31, 2003, the entire disclosures of each of which are hereby incorporated herein by reference

NOTICE OF COPYRIGHT PROTECTION

A portion of the disclosure of this patent document and its figures contains material subject to copyright protection. The copyright owner has no objection to the facsimile reproduction by anyone of the patent document, but otherwise reserves all copyrights whatsoever.

FIELD OF THE INVENTION

The present invention generally relates to providing a haptic effect. The present invention more particularly relates to providing a haptic effect to a musical instrument.

BACKGROUND

Designers and manufacturers of musical equipment, such as electronic pianos, are constantly striving to improve the musical equipment. For example, designers and manufacturers continue striving to make electronic instruments perform and feel like non-electronic musical instruments. One difference between electronic instruments and non-electronic instruments is that many electronic instruments typically provide little to no realistic haptic effects. As a result, musicians playing many electronic instruments can only hear the music and cannot feel a satisfactory response to the music. In other words, pressing down on a key on an electronic keyboard feels differently than pressing down on a key on a piano, as there is generally no appreciable vibration from the key on the electronic keyboard and/or no appreciable resistance from the key on the electronic keyboard that is usable in an effective manner by most users of electronic musical instruments.

Another area for improvement is teaching musical instruments. Traditionally, a student watches a teacher play an instrument, and the student learns visual and acoustically. Piano lessons are typically taught with a student sitting next to a teacher with the teacher playing the piano thus demonstrating how to play a particular melody. Since the student does not have their fingers on the keyboard, the student cannot feel haptic feedback on the keys of the piano. Thus, the student cannot feel, in an effective and efficient manner, the instructor pressing down harder on one key than the other keys.

Thus, a need exists for methods and systems for providing haptic effects to a musical instrument.

SUMMARY

Embodiments of the present invention provide systems and methods for providing a signal associated with a haptic effect to a musical instrument. In one embodiment, a processor can receive a first signal having a set of parameters relating to sound, select a haptic effect from one or more look-up tables using at least one predetermined parameter from the set of parameters, and output a second signal associated with the haptic effect. In another embodiment, the processor can receive a first signal having a set of parameters relating to sound, compute a haptic effect using at least one predetermined parameter from the set of parameters, and output a second signal associated with the haptic effect. The first signal can come from a variety of sources including, but not limited to, a musical instrument, a wireless medium (over the air) or a file stored in memory, e.g., a MIDI file. In one embodiment, the second signal can be provided to one or more actuators, which provide the haptic effect to the musical instrument. In one such embodiment, the haptic effect is provided to the input member that caused the first signal to be generated. In still another embodiment, the haptic effect can be provided to the housing of the musical instrument that caused the music signal to be generated. In another embodiment, the haptic effect is provided to the musical instrument simultaneously with the music being amplified, so that the musician can hear and feel the music that he or she is creating. In yet another embodiment, the haptic effect is provided to a musical instrument which did not cause the first signal to be generated.

BRIEF DESCRIPTION OF THE DRAWINGS

These and other features, aspects, and advantages of the present invention are better understood when the following Detailed Description is read with reference to the accompanying drawings, which constitute part of this specification.

DETAILED DESCRIPTION

Embodiments of this invention are described herein in the context of musical instruments. Embodiments of the invention can also be used in other contexts such as cell phones, PDAs, game controllers, surgical simulators, or any other system or method employing haptic effects. The phrase MIDI signal refers to signals using the MIDI protocol. MIDI signals refer to signals generated in accordance with the MIDI protocol, e.g., MIDI messages. Although, the detailed description uses MIDI signals/protocol as an example, other signals and/or protocols such as the mLAN protocol developed by the Yamaha Corporation of America can be utilized in accordance with embodiments of the present invention.

Figure 1:
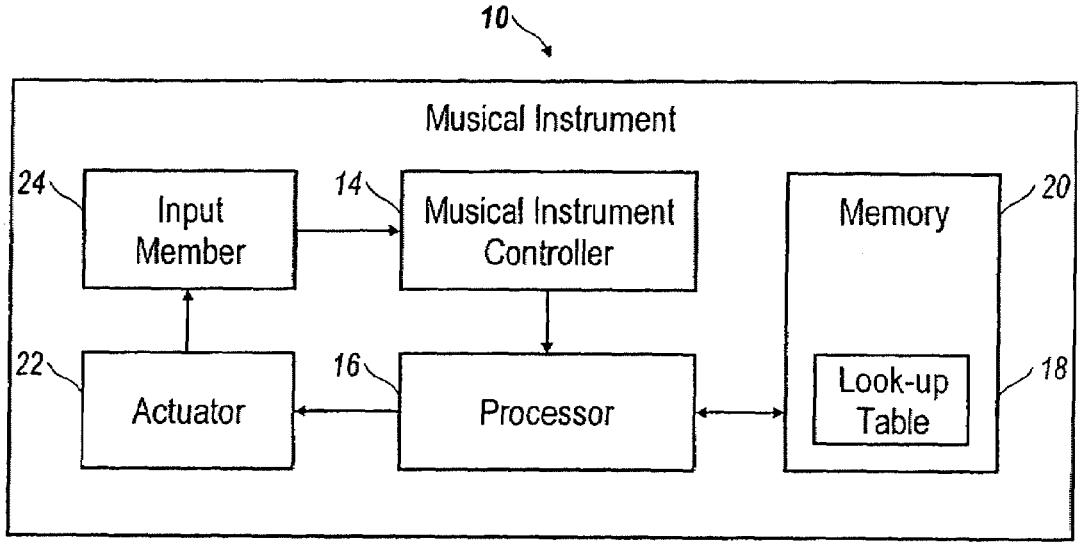
FIG. 1 is a block diagram of an exemplary system for providing a signal associated with a haptic effect to a musical instrument in accordance with an embodiment of the present invention.
Figure 2A:
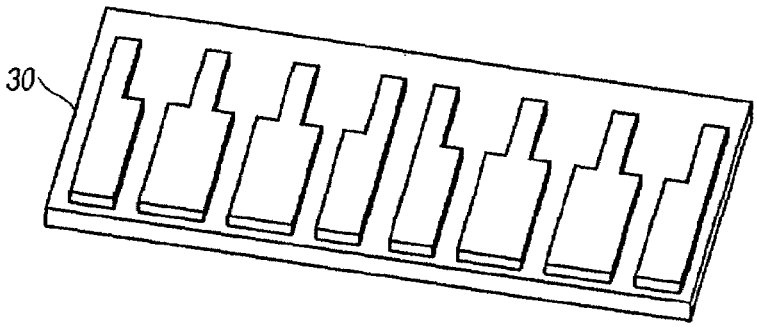
FIGS. 2A-2E are different views of exemplary instruments in accordance with different embodiments of the present invention.
Figure 2B:
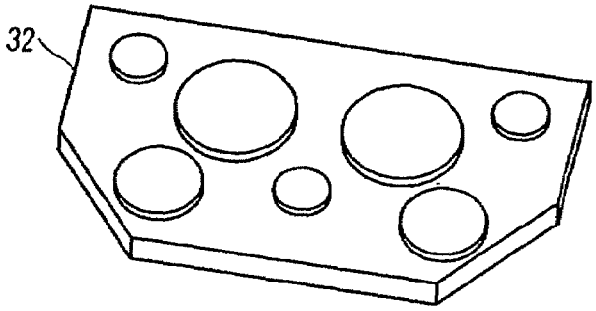
Figure 2D:
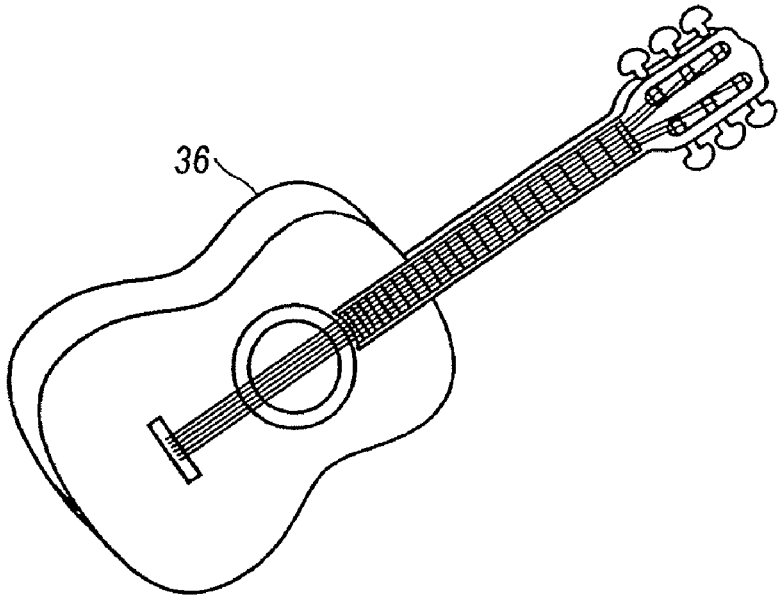
Figure 2C:
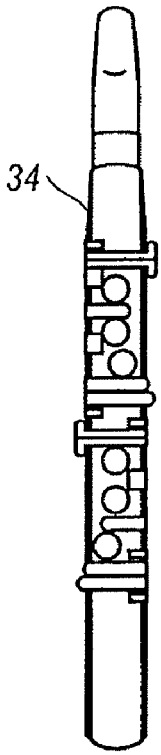
Figure 2E:
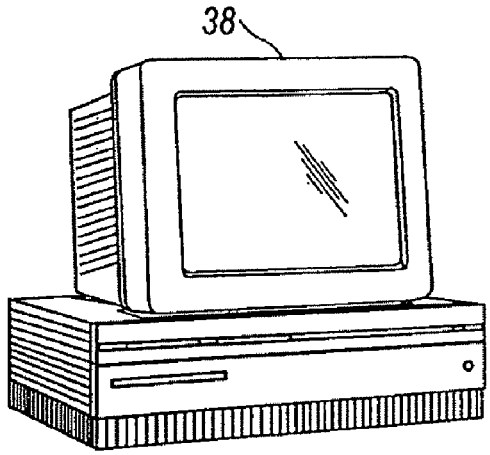

Referring now to the drawings in which like numerals indicate like elements throughout the several figures, FIG. 1 illustrates a block diagram of an exemplary system 10 for providing a signal associated with a haptic effect to a musical instrument in accordance with one embodiment of the present invention. As shown in FIG. 1, the system 10 comprises a musical instrument 12. The musical instrument can include a keyboard 30 (FIG. 2A), a drum pad 32 (FIG. 2B), a wind controller 34 (FIG. 2C), a guitar 36 (FIG. 2D), a computer 38 (FIG. 2E) configured to produce music, or any suitable musical instrument.

Referring to FIG. 1 again, the musical instrument 12 can further include a musical instrument controller 18 configured to generate a first signal having a set of parameters relating to sound. The first signal can be, but is not limited to, a music signal, a MIDI signal, or other signals as known in the art. Examples of the parameters relating to sounds can include, but are not limited to, start, delay, duration, waveform, frequency, magnitude, and envelope (attack time, attack level, fade time, fade level, etc.). Some of the parameters can be time varying. The parameters can be MIDI parameters and can include, but are not limited to, MIDI note number, note velocity, note duration, note volume, channel number, patch number, MIDI notes, or another parameter or variable that can be associated with a MIDI signal.

The musical instrument controller 18 can generate one or more first signals in response to a musician playing the musical instrument 12 as known in the art. For example, the music instrument controller 18 can generate a first signal in response to a musician actuating an input member 24 on the musical instrument 12, such as pressing down on a key on a keyboard or strumming a guitar string on a guitar. An input member 24 comprises a member associated with sound, music, or a musical instrument that can be actuated directly or indirectly by a user. Examples include, as mentioned, a keyboard key or a guitar string. Examples also include a computer-keyboard key, or another type of key or button. When an input member 24 is actuated, a sensor can detect the event and send one or more sensor signals to the musical instrument controller 14. The musical instrument controller 14 can be configured to generate one or more first signals in response to receiving the one or more sensor signals. In another embodiment, the musical instrument controller 18 can be configured to generate one or more first signals, e.g., MIDI signals, in response to reading a file, e.g., a MIDI file, stored in memory 20. The file can be correlated to various events as known in the art. In yet another embodiment, the music instrument controller 14 can receive the first signal from the musical instrument 12 via a microphone (not shown).

The system 10 can further include a processor 16 configured to receive a first signal, e.g., a MIDI signal, and determine one or more haptic effects, which are correlated to the first signal. The processor 16 is configured to execute computer-executable program instructions stored in memory 20. Such processors can include any combination of one or more microprocessors, ASICs, and state machines. Such processors include, or can be in communication with, media, for example computer-readable media 20, which stores instructions that, when executed by the processor, cause the processor to perform the steps described herein. Embodiments of computer-readable media include, but are not limited to, an electronic, optical, magnetic, or other storage or transmission device capable of providing a processor with computer-readable instructions. Other examples of suitable media include, but are not limited to, a floppy disk, CD-ROM, DVD, magnetic disk, memory chip, ROM, RAM, an ASIC, a configured processor, all optical media, all magnetic tape or other magnetic media, or any other medium from which a computer processor can read instructions. Also, various other forms of computer-readable media can transmit or carry instructions to a computer, including a router, private or public network, or other transmission device or channel, both wired and wireless. The instructions can comprise code from any suitable computer-programming language, including, for example, C, C+, C++, Visual Basic, Java, Python, and JavaScript. The controller 14 shown in FIG. 1 can comprise such a processor.

Referring still to FIG. 1, the processor 16 can be configured to receive the first signal having a set of parameters relating to sound and to generate a second signal associated with a haptic effect. In one embodiment, the processor 16 can use one or more look-up tables 18 stored in memory 20 to determine the haptic effect corresponding to the first signal, e.g., MIDI signal. The look-up tables 18 can be stored in a database which can be stored in memory 20. The look-up tables 18 can be pre-programmed by the manufacturer of the musical instrument, provided as a third-party add-on to the instrument, provided as a stand-alone module, programmed by the user or a third party, or provided in any other suitable manner. In one embodiment, the look-up tables 18 contain parameters relating to sound which are mapped to zero or more haptic effects, with the haptic effects being controlled by the parameters associated with the sound. In other embodiments, including the embodiment shown in FIG. 1, signals having parameters, e.g., MIDI signals, are mapped to haptic effects and can be based on a predetermined parameters, e.g., the note number, such as a MIDI note number, note velocity, note duration, note volume, channel number, patch number, notes, MIDI notes, or another parameter or variable that can be associated with a first signal. As a result, the haptic effect can correlate to, for example, the characteristics of the input from the musician.

In another embodiment, the processor 16 can be configured to compute the second signal based on the first signal, e.g. MIDI signal. For example, the second signal can be computed as a waveform based on attributes of a predetermined parameter, e.g., a MIDI note. Some of the attributes controlling the second signal can be pre-defined and selectable by particular combinations of MIDI signals, while other attributes can be computed from the first signal. For example, the patch number for a note can select a specific communication of waveform and envelope parameters while the note number and duration can modify the frequency, magnitude and envelope parameters. The resulting haptic effect frequency can be different from the MIDI signal frequency.

Referring again to FIG. 1, the system 10 can further include one or more actuators 22 configured to receive the second signal and provide the associated haptic effect to one or more input members 24 or to a surface or the housing of the musical instrument 12. The haptic effects can be kinesthetic feedback (such as, without limitation, active and resistive force feedback), and/or tactile feedback (such as, without limitation, vibration, texture, and heat). The haptic effect and the amplification of the music can be synchronized.

One or more actuators 22 can be coupled to a corresponding input member 24. In one embodiment, each input member 24 can be coupled to a corresponding actuator 22. In one embodiment, the one or more haptic effects can be provided to the input member 24 which caused the first signal to be generated. For example, the haptic effect is provided to a keyboard key that the musician has pressed down, or to a guitar string that the musician strummed. In yet another embodiment, the one or more haptic effects can be provided to the input member 24 which caused the first signal to be generated and to one or more input members 24 which correspond to the input member 24 which caused the generation of the first signal with the corresponding input member or members being on a different scale. For example, if a teacher presses down on a key on a electronic keyboard, the haptic effect is provided to the key that was pressed down and one or more corresponding keys on one or more different scales. In such an embodiment, a student could feel the haptic effect on a corresponding key.

In one embodiment, one or more actuators 22 are coupled to a surface or housing of a musical instrument 12 and apply the one or more haptic effects to the surface or housing of the musical instrument 12 with one or more haptic effects being associated with one or more first signals. For example, one or more actuators 22 are coupled to the body or neck of a guitar, the body of a wind instrument, or to the drum pad of a drum.

Various types of actuators can be utilized in different embodiments of the present invention. These actuators can provide any combination of vibrational feedback, force feedback, resistive feedback, or any kind of haptic feedback appropriate for a given effect. For example, in one embodiment, a motor can provide a rotational force. In another embodiment, a motor can drive a belt that is configured to produce a rotational force directly or indirectly on an input member 24 or to the housing of a musical instrument 12. In yet another embodiment, a motor can be connected to a flexure, such as a brass flexure, which produces rotational force on the input device. Exemplary actuators are described in further detail in PCT Patent Application No. PCT/US03/33202 having an international filing date of Oct. 20, 2003, the entire disclosure of which incorporated herein by reference.

Figure 3:
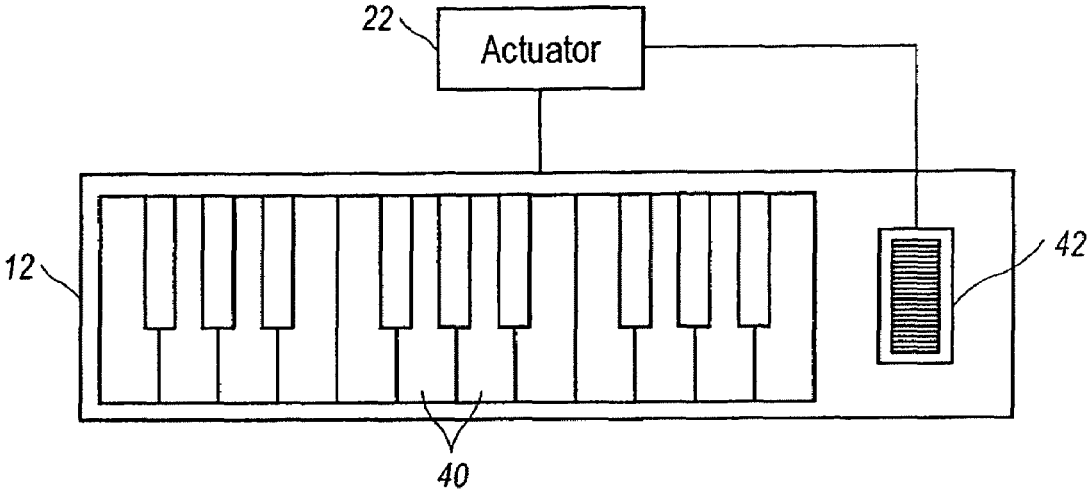
FIG. 3 is a perspective view of keys on a keyboard and a pitch bend having an associated actuator in accordance with an embodiment of the present invention.

Referring to FIG. 3, a perspective view of a keyboard in accordance with an exemplary embodiment of the present invention is illustrated. As shown, the keyboard 12 includes a plurality of input members—keys 40 and a rotary control 42 (e.g., a pitch bend) with one or more actuators 22 providing the one or more haptic effects to the input members 40, 42. The pitch bend 42 produces a change in pitch in response to the movement of a pitch bend wheel or lever. The actuator 22 can provide the haptic effect in the form of kinesthetic feedback in response to the movement of the pitch bend 42 or can provide a haptic effect in the form of tactile feedback in response to the effect of the movement of the pitch bend 42 as described above. Exemplary actuators that can provide resistance for a pitch bend are described in further detail in U.S. patent application Ser. No. 10/314,400 having a filing date of Dec. 8, 2002, the entire disclosure of which incorporated herein by reference.

Similarly, one or more actuators 22 can provide the haptic effect to a pitch bend arm on a guitar (not shown). The actuators 22 can provide the haptic effect in the form of kinesthetic feedback in response to the movement of the pitch bend arm or can provide a haptic effect in the form of tactile feedback in response to the effect of the movement of the pitch bend arm as described above.

Figure 4:
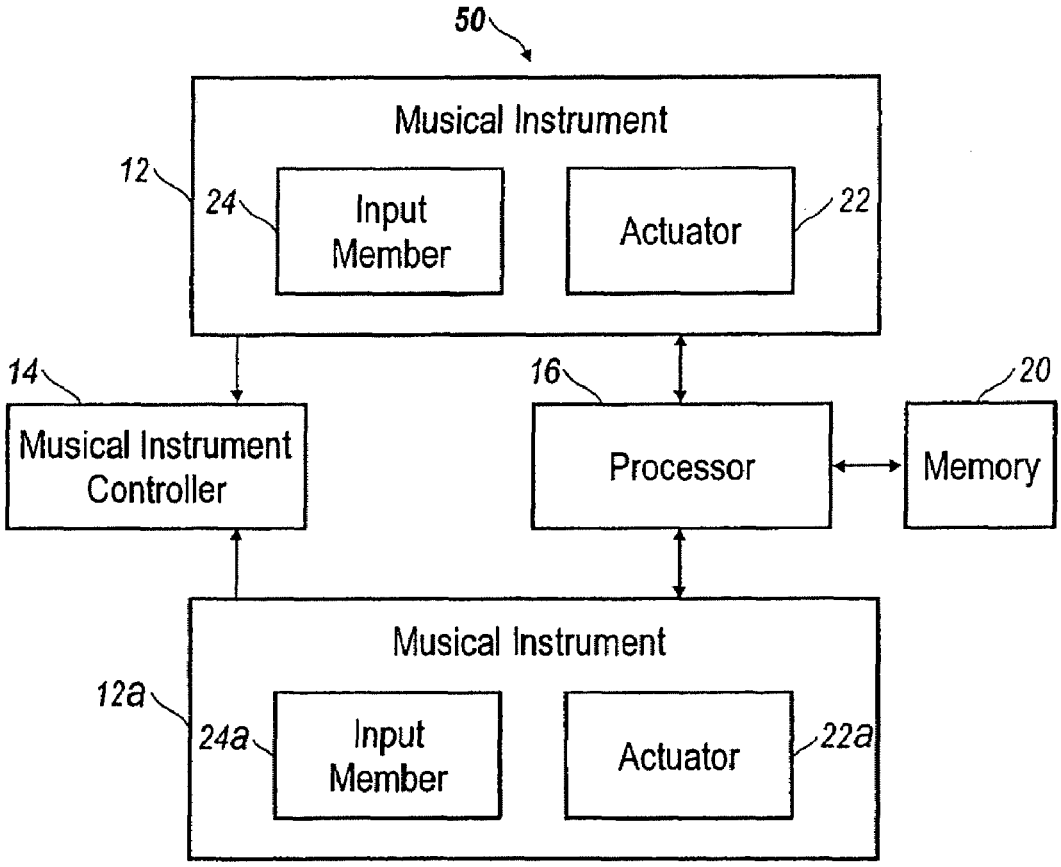
FIG. 4 is a block diagram of an exemplary system for providing a signal associated with a haptic effect to a musical instrument in accordance with an embodiment of the present invention.

Referring to FIG. 4, a block diagram of an exemplary system 50 for providing a signal associated with a haptic effect to a musical instrument in accordance with an embodiment of the present invention is illustrated. As shown in FIG. 4, the system 50 includes a musical instrument 12, a musical instrument controller 14, and a processor 16 with each being an individual component. In an alternate embodiment, the music instrument controller 14 can be part of the musical instrument 12. In another alternate embodiment, the music instrument controller 14 and the processor 16 can be combined.

As shown in FIG. 4, the musical instrument controller 14 is separate from the musical instrument 12 and can be a pickup controller for the musical instrument 12, e.g., a pick-up controller for a guitar. In one embodiment, the musical instrument controller 14 can be configured to receive sensor signals based on user input, e.g., a musician pressing a key on a keyboard or strumming the string on a guitar. The musical instrument controller 14 can be configured to generate one or more first signals based on the sensor signals. In another embodiment, the musical instrument controller 14 can be configured to generate one or more first signals, e.g., MIDI signals, in response to reading a file, e.g., a MIDI file, stored in memory 20. The file can be correlated to various events as known in the art. The processor 16 is configured to generate second signals associated with one or more haptic effects correlated to the one or more first signals.

In another embodiment, the processor 16 can be configured to receive one or more first signals from the musical instrument 12 either directly or via a wireless connection. In this other embodiment, the processor 16 does not require the use of a musical instrument controller 14. Hence, the processor 16 can receive one or more first signals and generate one or more second signals associated with one or more haptic effects correlated to the one or more first signals. For example, the musical instrument 12 can be a player piano, in which the stored signals are reproduced on the player piano, e.g., the player's touch timing, velocity, duration and release.

In yet another embodiment, the system 10, 50 can include more than one musical instrument 12. For example, as shown in FIG. 4, a first instrument 12 and a second instrument 12*a* can be coupled with the processor 16 being configured to receive one or more first signals from one of the musical instruments 12, 12*a* and/or from one or more first signals stored in memory 20. The processor 16 can be configured to convert the one or more first signals into one or more second signals which are provided to one or more of the coupled musical instruments, e.g., the first musical instrument 12 and/or the second musical instrument 12*a*. In addition, the musical instruments 12, 12*a* can be different instruments. For example, the first musical instrument 12 can be a guitar and the second musical instrument 12*a* can be a keyboard. In embodiments in which the second signal is being provided to a musical instrument which caused the first signal, the second signal can be referred to as a haptic feedback signal. For example, if two musical instruments are coupled via the processor 16, the musical instrument 12, 12*a* that caused the music signal can receive the haptic feedback signal and the other musical instrument 12*a*, 12 would receive a second signal which matches the haptic feedback signal. If the two musical instruments 12, 12*a* are different musical instruments, then the haptic effect can be provided to an input member 24 corresponding to the input member 24 which generated the first signal.

Figure 5:
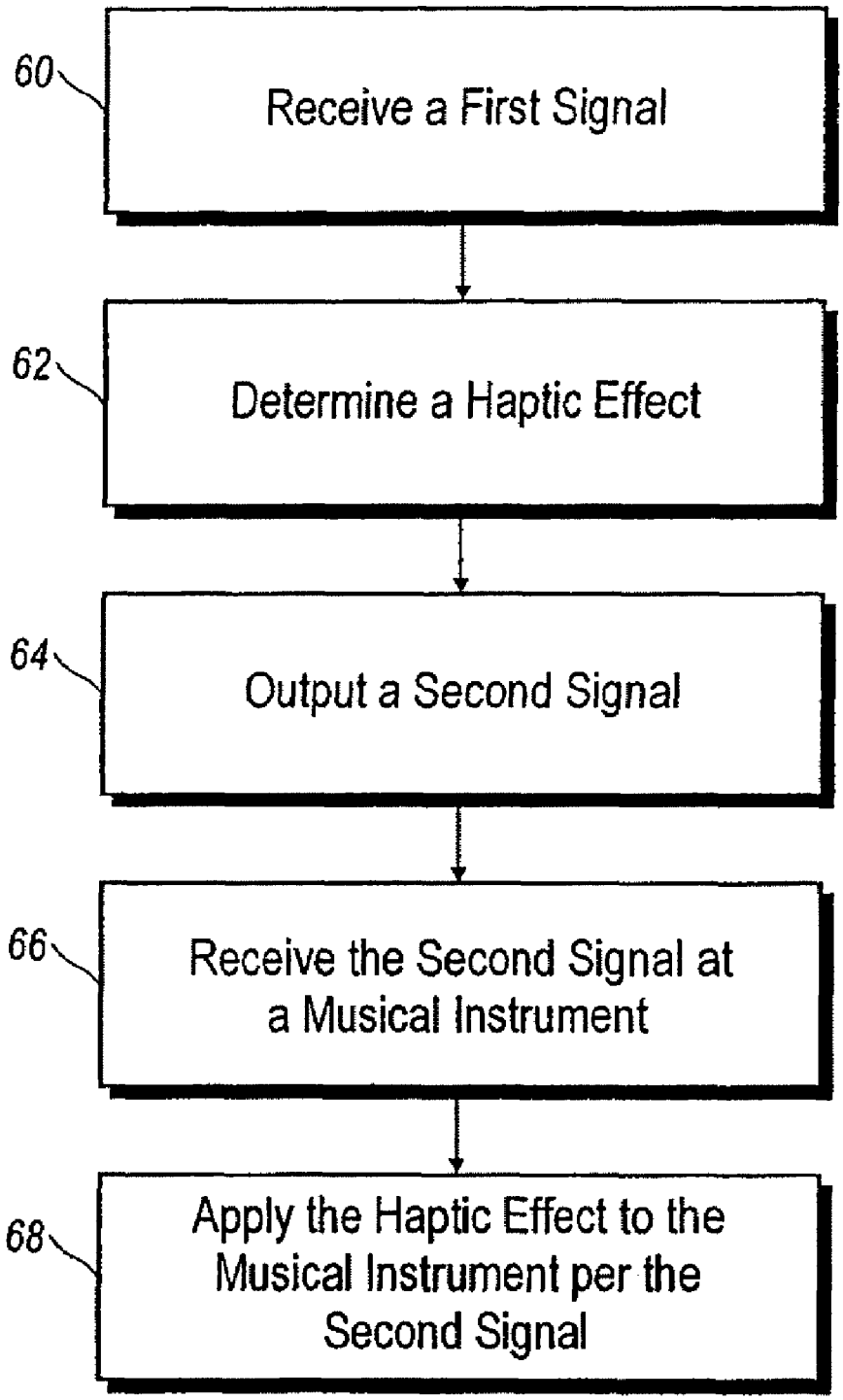
FIG. 5 is a flowchart, illustrating a flow of information between various modules of the firmware in an embodiment of the present invention.

Referring to FIG. 5, a method utilizing an embodiment of the present invention is illustrated. The method can start with a processor 16 receiving a first signal 60. The first signal can be from a sensor detecting a musician playing the instrument, from a memory, from a stored file, e.g., a MIDI file, from another instrument, via a wireless connection, or from any other medium known in the art. The processor 16 receives the first signal and generates one or more second signals associated with one or more haptic effects that correlate to the first signal 62. This can include the processor 16 accessing a look-up table to determine the mapped haptic effect correlated to the first signal or can compute the second signal associated with one or more haptic effects correlated to the first signal. The processor 16 outputs the second signal 64. One or more musical instruments 12 receive the second signal 66. A haptic effect is applied to the musical instrument according to the second signal 68. For example, a local processor (not shown) in the musical instrument 12 can receive the second signal and provide an actuation signal to one or more corresponding actuators 22. The actuation signal comprises an indication that the actuator 22 should actuate (e.g. vibrate or provide resistance). The communication between the actuator 22 and the one or more input members 24 can be configured such that the actuator's actuation provides haptic feedback (e.g., in the form of vibrations or resistance) to the one or more input members 24. In other embodiments, this step can comprise the one or more actuators 22 receiving the second signal from the processor 16 and then actuating to provide the haptic effect to one or more input members 24. The one or more actuators 22 can provide different haptic effects based on the second signal or actuation signal. For example, different haptic effects can be provided by regulating the current delivered to an actuator 22, the duration of the current delivered to an actuator 22, the time cycles between cycles of energizing an actuator 22, and the number of cycles of energizing an actuator 22. These conditions can be varied to produce a variety of haptic effects. The haptic effect can be applied to an input member 24 that caused the first signal, for example a key on a keyboard being pressed down or a string on a guitar being strummed. Alternately, the haptic effect can be applied to the surface or the housing of the musical instrument 12, such as the neck of a guitar. In another embodiment, the haptic effect can be applied to one or more musical instruments 12.

The foregoing description of the preferred embodiments of the invention has been presented only for the purpose of illustration and description and is not intended to be exhaustive or to limit the invention to the precise forms disclosed. Numerous modifications and adaptations thereof will be apparent to those skilled in the art without departing from the spirit and scope of the present invention.

What is claimed is:

1. A system comprising:

a database comprising at least one haptic effect; and a processor in communication with the database and a game controller comprising an actuator, the processor configured to:

receive a first signal having a set of parameters relating to sound;

receive an input signal from the game controller;

select the at least one haptic effect from the database, the selection based on at least one predetermined parameter from the set of parameters and the input signal;

output a second signal to the game controller, the second signal based on the haptic effect.

2. The system of claim 1 wherein the database comprises at least one look-up table comprising the at least one haptic effect.

3. The system of claim 1 wherein the processor is configured to receive the first signal by reading the first signal from a file.

4. The system of claim 3 wherein the file is a musical instrument digital interface (MIDI) file.

5. A method comprising:

receiving a first signal having a set of parameters relating to sound;

receive an input signal from a game controller comprising an actuator;

selecting a haptic effect from a database, the selection based on at least one predetermined parameter from the set of parameters and the input signal; and outputting a second signal to the game controller, the second signal based on the haptic effect.

6. The method of claim 5 further comprising reading the first signal from a file.

7. The method of claim 5 wherein the database comprises at least one look-up table comprising the at least one haptic effect.

8. A computer-readable medium on which is encoded program code to be executed by a processor to perform a method, the computer-readable medium comprising:

program code to receive a first signal having a set of parameters relating to sound;

receive an input signal from a game controller comprising an actuator;

program code to select a haptic effect from a database, the selection based on at least one predetermined parameter from the set of parameters and the input signal; and program code to output a second signal to the game controller, the second signal based on the haptic effect.

9. The computer-readable medium of claim 8 further comprising program code to read the first signal from a file.

10. The computer-readable medium of claim 8 wherein the database comprises at least one look-up table comprising the at least one haptic effect.

11. The system of claim 1, wherein the game controller comprises at least one of a keyboard, a drum pad, a wind controller, or a guitar.

12. The system of claim 1, wherein the processor is in communication with a plurality of game controllers, each of the plurality of game controllers comprising at least one actuator.

13. The system of claim 12, wherein the plurality of game controllers comprises a first game controller and a second game controller, and wherein the processor is further configured to receive a first signal from the first game controller based at least in part on a manipulation of the first game controller, and transmit the actuator signal to the second game controller.

14. The method of claim 5, wherein the game controller comprises at least one of a keyboard, a drum pad, a wind controller, or a guitar.

15. The method of claim 5, further comprising:

receiving the input signal from the first game controller based at least in part on a manipulation of the first game controller, and transmitting the second signal to a second game controller.

16. The method of claim 15, wherein the first game controller comprises at least one of a keyboard, a drum pad, a wind controller, or a guitar, and the second game controller comprises at least one of a keyboard, a drum pad, a wind controller, or a guitar.

17. The computer-readable medium of claim 8, further comprising:

program code for receiving the input signal from the first game controller based at least in part on a manipulation of the first game controller, and program code for transmitting the second signal to a second game controller.

* * * * *